US005577283A

United States Patent [19]

Badami et al.

[11] Patent Number: 5,577,283

[45] Date of Patent: Nov. 26, 1996

[54] ENERGY EFFICIENT WASHER WITH INERTIA BASED METHOD FOR DETERMINING LOAD

[75] Inventors: Vivek V. Badami, Schenectady; Mark E. Dausch, Latham; Walter Whipple, III, Amsterdam, all of N.Y.; Richard E. Hornung, Fisherville; Donald R. Dickerson, Jr., Louisville, both of Ky.

[73] Assignee: General Electric Company, Schenectady, N.Y.

[21] Appl. No.: 406,424

[22] Filed: Mar. 20, 1995

[51] Int. Cl.[6] ..... D06F 33/02

[52] U.S. Cl. ..... 8/158; 68/12.04; 68/12.19

[58] Field of Search ..... 8/158, 159; 68/12.02, 68/12.04, 12.19

[56] References Cited

U.S. PATENT DOCUMENTS

| | | | |
|---|---|---|---|
| 4,607,408 | 8/1986 | Didier et al. | 8/159 |
| 5,042,276 | 8/1991 | Kamano et al. | 68/12.04 |
| 5,092,140 | 3/1992 | Matsuo et al. | 68/12.04 |
| 5,144,819 | 9/1992 | Hiyama et al. | 68/12.04 |
| 5,161,393 | 11/1992 | Payne et al. | 68/12.04 |
| 5,233,847 | 8/1993 | Tanaka | 68/12.04 |
| 5,291,626 | 3/1994 | Molnar et al. | 8/158 |
| 5,313,964 | 5/1994 | Dausch et al. | 134/57 D |
| 5,330,580 | 7/1994 | Whipple, III et al. | 134/18 |
| 5,408,716 | 4/1995 | Dausch et al. | 8/158 |

*Primary Examiner*—Philip R. Coe
*Attorney, Agent, or Firm*—Donald S. Ingraham

[57] ABSTRACT

An energy saving method of operating a washing machine such that the amount of water added to the washer basket is proportionate to the weight of the articles to be washed includes the steps of determining a normalized inertia of the washer basket loaded with articles to be cleaned; determining an estimated weight of the load of articles to be washed based upon the normalized inertia value; and controlling a washer water supply system to add a load-specific volume of water to the washer basket, the magnitude of the load-specific volume of water corresponding to the estimated weight of the articles to be washed. An energy efficient washing machine in accordance with this invention includes an induction motor coupled to the washer basket, a washer water supply system coupled to the washer basket, and a washer controller coupled to the drive motor and the washer water supply system so as to respectively control operation thereof. The washer controller includes a load weight circuit for generating control signals for the washer water supply system to add a load-specific volume of water to the washer basket in correspondence with an inertia-based estimated load weight signal generated by the load weight circuit.

18 Claims, 2 Drawing Sheets

ENERGY EFFICIENT WASHER WITH INERTIA BASED METHOD FOR DETERMINING LOAD

BACKGROUND OF THE INVENTION

This invention relates generally to energy efficient washing machines for cleansing clothes and similar articles and more particularly to washing machines that consume only the optimal amount of water that is required for the size of the load of articles to be cleaned.

On most conventional washing machines, the amount of water that the machine uses in a washing cycle is determined by the operator via a manual control, such as a load size selector switch. Such manual controls typically offer a limited number of selections (e.g., small, medium, or large); such selections may not offer a load size option appropriate for a given load. It is also common that a larger size load is selected than is actually needed to achieve effective cleaning of the articles to be washed. Use of more water than is needed for effective cleaning leads to a waste of water and of energy used to heat and circulate the water.

Automated control of water added to the washer during a wash cycle has been suggested as one means of minimizing energy usage in a washer. Typically the most important factor in determining the appropriate amount of water to provide effective cleaning is the weight of the articles to be cleaned. In washers having advanced motor controls so that a given torque can be commanded (such as a Switched Reluctance Motor (SRM), electronically commutated mortor (ECM), or the like), the determination of clothes weight can be done by measuring the torque and then determining the inertia of articles in the washer basket. Determination of this inertia cannot, however, be readily accomplished if one cannot directly control or measure torque of the motor driving the basket, such as is the case with conventional electrical induction motors without special controls. Command torque motors such as the SRM are more complex and expensive than the commonly-used induction motors; similarly, inferred or direct measurement of torque typically requires use of equipment that results is more complex and expensive than is desirable in household appliances due to the need for complex power electronics in the appliance, or the use of extra sensors for determining the torque.

It is desirable to provide the energy-saving advantages of load determination without the necessity of having equipment in the washing machine that makes it more complex and expensive. It is thus an object of one embodiment of this invention to provide an energy efficient method of operating a washing machine using a normalized inertia-based load determination in a machine in which torque is not readily directly commanded or set. Such an inertia-based system is readily adapted for use in a washing machine in which the drive motor for the basket is either a single speed or a multiple speed electric induction motor.

SUMMARY OF THE INVENTION

An energy saving method of operating a washing machine having a drive motor without direct torque command or torque measurement controls is adapted to add an amount of water to the washer basket that is proportionate to the weight of the articles to be washed. The method includes the steps of determining, prior to the completing the addition of water preparatory to commencing a wash cycle, a normalized inertia of the washer basket loaded with articles to be cleaned; determining an estimated weight of the load of articles to be washed based upon the normalized inertia value; and controlling a washer water supply system to add a load-specific volume of water to the washer basket, the magnitude of the load-specific volume of water corresponding to the estimated weight of the articles to be washed. The steps of determining the normalized inertia include determining a first loaded-basket acceleration value of the washer basket loaded with the articles to be cleaned, the acceleration of the basket being in response to applying a first torque to the basket; and determining a second loaded-basket acceleration value of the washer basket in response to applying a second torque to the loaded basket. The normalized inertia is determined in accordance with the following relationship:

$$In=(dA_o)/(dA)$$

wherein $I_n$ is the normalized inertia; $dA_o$ is a predetermined value of acceleration difference for an unloaded washer basket, and dA is the difference of said first and second loaded-basket acceleration values. The step of determining the estimated weight of the load of articles to be washed includes accessing a look-up table to provide an estimated weight corresponding with the value of normalized inertia. Following determination of an estimated weight of the load of articles to be washed, a washer water supply system is controlled to add a load-specific volume of water to the washer basket, the load-specific volume corresponding to the estimated weight of the articles to be washed.

Alternatively, an acceleration value "A" determined from a single torque applied to the washer basket (such as in a machine having a single speed motor) can be used in conjunction with the known value of unloaded acceleration ($A_o$) to determine a normalized inertia ($I_n$). The relationship is as follows:

$$I/I_o=A_o/A=I_n \text{ (normalized inertia)}$$

The value of normalized inertia is used as above to determine a corresponding estimated mass of the articles in the washer basket.

An energy efficient washing machine in accordance with this invention includes an inductance type motor without direct torque command or torque measurement controls. The motor is coupled to the washer basket, a washer water supply system coupled to the washer basket, and a washer controller coupled to the drive motor and the washer water supply system so as to respectively control operation thereof. The washer controller includes a load weight circuit for generating control signals for the washer water supply system to add a load-specific volume of water to the washer basket in correspondence with a normalized inertia-based estimated load weight signal generated by the load weight circuit.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
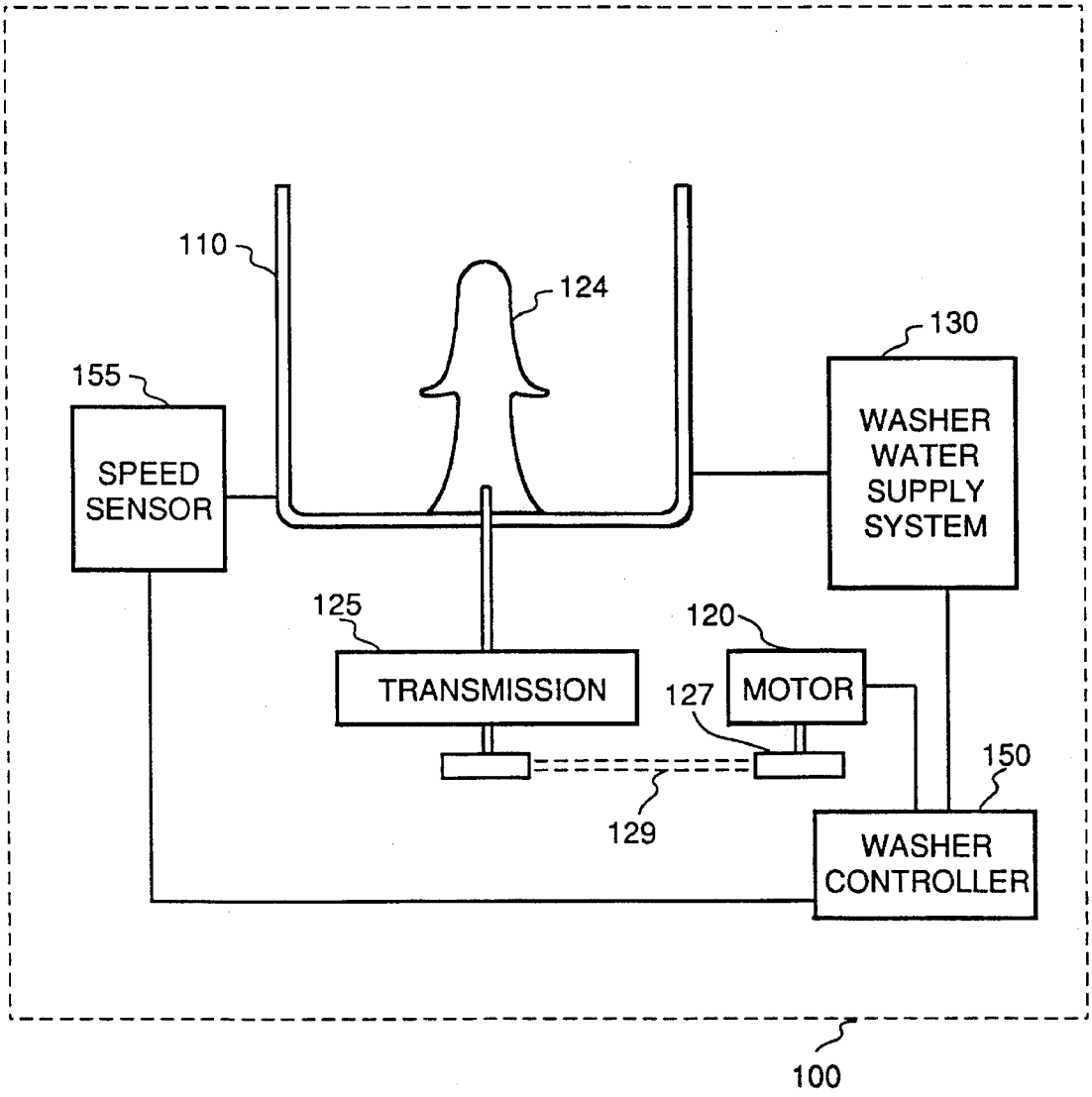
FIG. 1 is a block diagram of a washing machine in accordance with one embodiment of this invention.

An energy efficient washing machine 100 in accordance with this invention comprises a washer basket 110, a drive motor 120, a washer water supply system 130, and a washer controller 150 that is coupled to at least drive motor 120 and to washer water supply system 130 to control operation thereof. As used herein, "washing machine" refers to an appliance for cleaning of articles placed into washer basket 110; the articles are then cleaned through the addition of water into the basket (typically also with the addition of detergent) and the agitation of clothes within the water in basket 110. Common examples are household type washers for cleaning clothes and the like. As illustrated in FIG. 1, washing machine 100 typically comprises a vertical axis machine (that is, the washer basket is oriented so as to rotate about a vertical axis); alternatively, washing machine 100 may comprise a horizontal axis machine.

Drive motor 120 typically comprises an electric induction motor without direct torque command or torque measurement controls. Thus, in accordance with this invention, motor 120 of washing machine 100 is a type which does not have the capability to either command a particular (or known) torque value at its output shaft (certain motors modified with complex and expensive electronics, such as ECMs, do provide such a capability, but the use of such motors is limited by cost and complexity factors with respect to fabrication and operation), or to detect directly the torque imparted by drive motor 120. This type of motor is rugged, reliable, and inexpensive and hence well adapted for use in typical washing machines. Motor 120 is coupled to washer basket 110 through a clutch 127 and a transmission 125; this arrangement typically (but not necessarily) includes belts and pulleys (as illustrated in FIG. 1) so that the rotation of the shaft of drive motor 120 is coupled to spin washer basket 110 and typically also to drive an agitator 124 or the like at appropriate times in a wash cycle. Further, as discussed in greater detail below with respect to respective embodiments of this invention, motor 120 may comprise a multiple speed motor (the speed be commanded by controller 150) or alternatively a single speed motor.

Washer water supply system 130 typically comprises plumbing and pumping equipment (not separately shown) to add water to and to drain water from washer basket 110. Such equipment is controllable by washer controller 150 such that a predetermined (that is, some known and measured) volume of water is added to washer basket 110 as a part of the machine's wash cycle. Determination of the volume of water added may be via, for example, level sensors on washer 100, flow volume measurement of water pumped into washer system, timed operation of a fixed displacement pump, or the like.

Washer controller 150 typically comprises an electronic processor, such as a computer, microprocessor chip, or the like, that has the capacity for receiving signals from sensors in the appliance and operator command signals, processing the signals to determine desired information therefrom, and generating command signals to control operation of drive motor 120 and washer water supply system 130. For example, washer controller 150 comprises a load determination circuit (not separately illustrated in FIG. 1) that functions as described below; as used herein, "load determination circuit" refers to the portion of the electronic processing elements of controller 150 that provides the desired processing of signals and generation of command signals in correspondence with the processed information for control of elements of washing machine 100. The load determination circuit may comprise dedicated circuitry in controller 150 or, alternatively, circuitry adapted for multiple uses in correspondence with processing instructions provided by the microprocessor (or microcontroller chip) or computer comprising the controller.

In accordance with this invention, energy efficient operation of washing machine 100 is provided washer controller 150 through control of drive motor 120 and washer water supply system 130 in accordance with the following method for determining a load-specific volume of water to be added to washer basket 110 for a wash cycle to clean such articles. As used herein, "load-specific volume" refers to an optimal volume of water to be added to the washer basket for cleaning of a given load of articles added to the basket, that is, an amount of water just sufficient to provide effective cleansing of the articles. The optimal amount of water for cleansing is determined primarily by the weight of the articles to be washed, with a lesser weight of articles requiring a smaller amount of water to cleanse effectively than a load of a larger weight. In washing machine 100, the wash cycle is commanded by the operator following addition of the articles to be washed; the load-specific volume of water appropriate for that wash cycle is determined preparatory to the commencement of the actions of the washing machine to cleanse the articles, such as agitating the clothes in the load-specific volume of water and detergent in the wash basket.

Following addition of the articles to be cleansed to washer basket 110 and the operator command to initiate a wash cycle, controller 150 generates command signals to operate the washer in accordance with the following energy saving method. A normalized inertia of the loaded washer basket is determined in the following manner. Drive motor 120 is energized to apply a first torque to cause movement of washer basket 110 (typically to spin the basket); as noted above, the value (or magnitude) of this first torque is unknown. A first loaded-basket acceleration value is determined (that is, corresponding to the application of the first torque on the washer basket loaded with the articles to be washed). Typically a washer basket speed sensor 155 is coupled to controller 150 so that the acceleration is readily determined by measuring the time interval between two predetermined washer basket speeds achieved while the first torque is applied by motor 120. The acceleration determination is performed prior to completing the addition of water preparatory to commencing a wash cycle; typically the acceleration determination is performed prior to the addition of any water to the washer basket.

Next, a second loaded-basket acceleration value is determined. Drive motor 120 is energized to apply a second torque to cause movement of washer basket 110. The magnitude of the second torque is unknown but it is different from the magnitude of the first torque applied. For example, drive motor 120 typically comprises a multi-speed motor, such as a motor in which the number of poles coupled to field current is selected to provide different motor speed, and the first and second torques are developed by the motor when different operating speeds are commanded by controller 150. As described above, the second loaded-basket acceleration value is determined by measuring the time interval between the washer basket reaching two predetermined speeds while the second torque is being applied.

During the period that drive motor 120 is accelerating washer basket 110, the respective magnitude of the first and second torques is substantially constant (e.g., the respective torque values do not vary more than about 5% from a constant value). In accordance with this invention, the substantially constant torque is applied to basket 110 by an induction motor without special controls to command a particular torque or acceleration (such as might be found on an ECM, SRM, or the like). The torque to accelerate the basket is typically applied through a clutch 127 that is concentric with the shaft of motor 120 and which is coupled to transmission 125 via a belt 129 (illustrated in phantom) and associated pulleys on the clutch and transmission assemblies. After motor start and during the period that basket 110 is accelerating, clutch 127 slips until the basket has almost reached its terminal rotational speed, resulting in a substantially linear speed ramp up to the terminal basket rotation speed (during the period when the clutch is slipping, the clutch is in effect limiting the torque applied to basket 110 to some relatively constant value). The linear speed ramp implies constant acceleration and in this operating regime it is properly assumed that the torque applied to the basket is constant. In the case of a two-speed motor, the respective basket speed ramp up curves are different as a function of the two different torques (e.g., a "low" torque and a "high" torque) applied. Respective low and high torques are obtained in an induction motor by switching between respective wiring configurations, each having a respective (and different from the other) number of magnetic poles in the motor circuit. Switching between the respective pole configurations is done electrically and readily accomplished by control signals from washer controller 150.

After the first and second loaded-basket acceleration values are determined, the normalized inertia of the washer basket loaded with the articles to be washed is determined in accordance with the following relationship:

$$I_n=(dA_o)/(dA) \tag{1}$$

wherein $I_n$ is the normalized inertia;

$dA_o$ is a predetermined value of acceleration difference for an unloaded washer basket, and dA is the difference of said first and second loaded-basket acceleration values.

The value of $dA_o$ is determined in a similar fashion to that described above for dA, with the exception that no articles are loaded in the washer basket. As such, $dA_o$ is a reference value and is typically determined for a given washing machine at time of manufacture so that the pertinent value can be recorded in controller 150. Controller 150 is typically capable of being calibrated through determination of an updated $dA_o$ value to reflect the in-service condition of the machine. Such a determination is done as a maintenance or repair once the machine is in the field and is not required during normal use by the operator.

The relationship for determining the normalized inertia value $I_n$ is derived in the following manner. The respective expressions for two different torques applied to the washer basket are:

$$T_1=I\times A_1+T_f \tag{2}$$

$$T_2=I\times A_2+T_f \tag{3}$$

wherein $T_1$ and $T_2$ are the applied torques of unknown value, 1 is the combined basket and clothes inertia, $A_1$ and $A_2$ are the respective acceleration values for the basket; such values are determined, for example, by measuring the time between two fixed, predetermined speeds (or a speed change over a fixed period) and $T_f$ is the unknown frictional torque that is essentially the same for both cases. Taking the difference of the two expression results in cancellation of the $T_f$ term:

$$T_1-T_2=I\times(A_1-A_2) \tag{4}$$

which can be rewritten as:

$$I=dT/dA \tag{5}$$

The expression for the inertia of an empty washer basket is as follows:

$$I_o=dT/dA_o \tag{6}$$

Dividing the expression of loaded basket inertia value (5) by the expression empty basket inertia (6), one obtains the expression for normalized inertia presented in equation (1) above. The normalized inertia value for the loaded washer basket is thus independent of the applied torque.

Alternatively, an acceleration value "A" determined from a single torque applied to basket 110 can be used in conjunction with the known value of unloaded acceleration ($A_o$) to determine a normalized inertia as noted below. One assumption in this method is that the frictional force in the unloaded acceleration ($A_o$) and the loaded acceleration (A) is the same. Another assumption is that the frictional torque ($T_f$) is small compared to the applied torque (e.g., less than about 5% of the value of the applied torque). Such a "single torque method" is necessarily used in a washing machine in which motor 120 has only one speed; alternatively the single torque method can be used in machines with multiple speed motors to reduce the time between the operator's command to commence the wash cycle and the addition of water to basket 110. A single speed motor 120 imparts a substantially constant during acceleration of basket 110 via clutch 127 as described above with respect to a two speed motor.

The single torque method relation is developed as follows:

$$T=(I\times A)+T_f \tag{7}$$

wherein T is the torque applied by motor 120, I in the inertia of basket 110 loaded with articles to be washed, A is the acceleration of loaded basket 110 in response to application of torque T, and Tf is the frictional torque.

Equation (7) implies that:

$$T-T_f=T'=I\times A \tag{8}$$

Similarly, for the unloaded basket:

$$T=(I_o\times A_o)+T_f \tag{9}$$

which provides that:

$$T-T_f+T'+I_oA_o \tag{10}$$

therefore:

$$I/I_o=A_o/A=I_n \text{ (normalized inertia)} \quad (11)$$

As noted above, processor 150 receives respective basket speed signals during the period torque T is applied to basket 110 and processes those signals to determine the respective acceleration value and the normalized inertial value.

Figure 2:
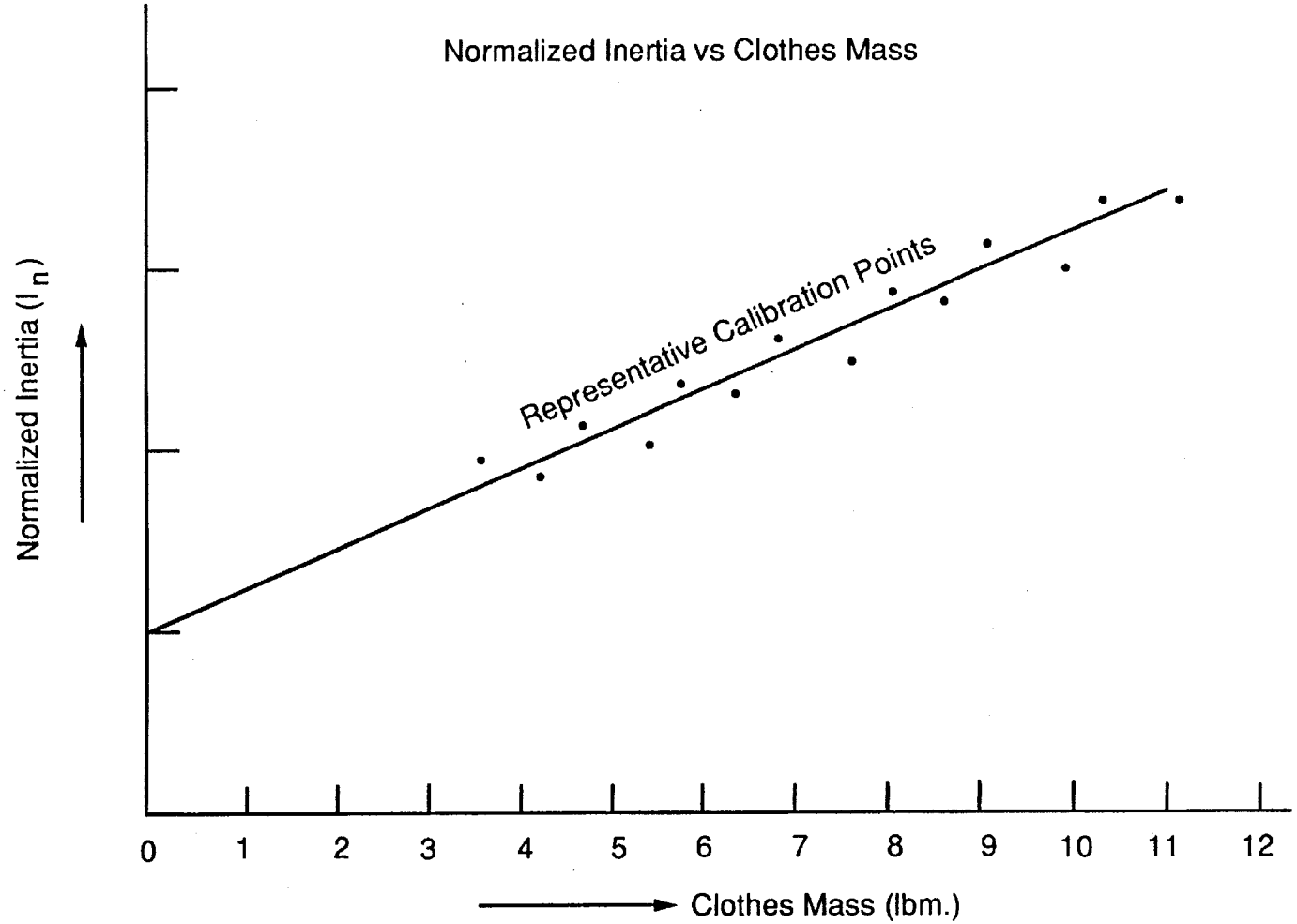
FIG. 2 is a graphic depiction of a look up table relating normalized inertia and estimated weight of articles to be washed.

Following determination of the normalized inertia of the washer basket (using either of the methods noted above), controller 150 operates to determine an estimated weight (or mass) of the load of articles to be washed. Typically, the load determination circuit comprises a memory register providing a look up table by which a particular normalized inertia value is related to a corresponding estimated weight of the articles to be washed. A graphic example of such a look up table appears in FIG. 2. The data pertaining to the relationship between normalized inertia values and corresponding weight of articles in the washer basket is typically developed in calibration trials run for a particular model of washing machine; e.g., representative data points are shown in FIG. 2 to illustrate how the nominal relationship of normalized inertial and clothes load weight is developed. Thus, for a given washing machine, controller 150 is typically programmed during the fabrication process with the model-specific look up table data and with the machine-specific value of $A_o$, the unloaded washer basket acceleration difference for the two drive motor speeds used for load determination, or alternatively, in the single torque method, for the single acceleration value $A_o$.

Alternatively, the load determination circuit of controller 150 processes the normalized inertia value in accordance with a relationship corresponding to a straight line that has been fitted to the calibration data. For example, a value of clothes mass q can be described as:

$$\eta=(y-c)/m \quad (12)$$

wherein $y=I_n=A_o/A$; c is the y axis intercept, and m is the slope of the line. This processing provides a calculated weight of the articles loaded in basket 110.

Following determination of an estimated weight of articles to be washed, controller 150 generates a signal to control operation of washer water supply system 130 to add a load-specific volume of water to washer basket 110. The magnitude of the load-specific volume of water corresponds to the estimated weight; the exact relationship of water volume to clothes load is generally linear but is typically determined experimentally for each type of washer so as to accurately provide sufficient volume to provide effective cleaning of the articles placed in basket 110. Following addition of the load-specific volume of water, the wash cycles commences with the agitation of the articles in the water and the like.

Thus, in accordance with this invention, a washing machine automatically determines the amount of water appropriate for the load of articles to be washed without input from the operator other than adding the items to be washed to the washer basket and initiating washing machine operation (machine 100 typically is adapted to provide the operator other choices, such as water temperature or fabric type). This arrangement enables the washing machine to use only an optimal amount of water for a given load, thereby avoiding waste of water and energy necessary to operate the washing machine and heat the water.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An energy-saving method of operating a washing machine having an electric induction motor without direct torque command or torque measurement controls by adding an amount of water to a washer basket so that the amount of water added is proportionate to the weight of the articles to be washed, the method comprising the steps of:

prior to completing addition of water preparatory to commencing a wash cycle, applying at least a first torque to cause movement of said washer basket filled with a load of articles to be washed, the magnitude of said first torque being unknown;

generating a first loaded-basket acceleration value signal for said washer basket in response to the application of said first torque;

determining a normalized inertia value of said washer basket as a function of said first loaded-basket acceleration value;

determining an estimated weight value for said load of articles to be washed as a function of said normalized inertia value; and controlling a washer water supply system to add a load-specific volume of water to said washer basket, the magnitude of said load-specific volume of water corresponding to said estimated weight value of said load of articles to be washed.

2. The method of claim 1 wherein said washer comprises a washer drive motor coupled to said washer basket and the step of applying torque to said washer basket comprises energizing said washer drive motor.

3. The method of claim 2 wherein the step of determining said loaded-basket acceleration value respectively comprises measuring the time interval between said washer basket being at a first predetermined speed and a second predetermined speed, said washer drive motor applying a substantially constant torque to accelerate said washer basket during said time interval.

4. The method of claim 2 wherein the step of determining said normalized inertia value signal for said washer basket as a function of the first loaded-basket acceleration value further comprises the steps of:

applying a second torque to cause movement of said washer basket filled said load of articles to be washed, the magnitude of said second torque being unknown but different from the magnitude of said first torque;

determining a second loaded-basket acceleration value signal for said washer basket in response to the application of said second torque; and processing the respective first and second loaded basket value signals to generate the normalized inertia signal in accordance with the following relationship:

$$I_n=(dA_o)/(dA)$$

wherein $I_n$ is the normalized inertia; $dA_o$ is a predetermined value of acceleration difference for an unloaded washer basket, and dA is the difference of said first and second loaded-basket acceleration values.

5. The method of claim 4 wherein the step of applying said first torque comprises operating said washer drive motor at a first speed and the step of applying said second torque comprises operating said washer drive motor at a second speed, said second speed being different than said first speed.

6. The method of claim 1 wherein said step of applying torque to said motor to determine a loaded-basket acceleration signal is performed prior to the addition of any water by said washer water supply system to said washer basket.

7. The method of claim 1 wherein the step of determining said estimated weight of said load of article to be washed comprises accessing a look-up table with the value of said normalized inertia, each value of normalized inertia having a corresponding estimated weight value in said look-up table.

8. The method of claim 1 wherein the step of determining said estimated weight signal for the load of articles to be washed comprises processing said normalized inertia value $I_n$ in accordance with following relationship corresponding to a sloped line determined from calibration data to determine the corresponding estimated weight signal η:

$$\eta=(I_n-c)/m$$

wherein c is the y axis intercept, and m is the slope of the line.

9. The method of claim 1 wherein the step of controlling a washer water supply system comprises controlling a water supply component, said water supply component consisting of a component selected from the group of water pumps and flow control valves.

10. The method of claim 1 wherein said washer comprises a machine selected from the group consisting of vertical axis washers and horizontal axis washers.

11. The method of claim 1 wherein the step of determining said normalized inertia value signal for said washer basket as a function of the first loaded-basket acceleration value further comprises the step of processing said first loaded-basket signal in accordance with the following relationship:

$$A_o/A=I_n$$

wherein $I_n$ is the normalized inertia; $A_o$ is a predetermined value of acceleration for an unloaded washer basket, and A is the first loaded-basket acceleration value.

12. An energy efficient washing machine providing load-specific water usage, said washing machine comprising:

a washer basket for containing articles to be washed;

a washer drive motor coupled to said washer basket, said washer drive motor comprises an electric induction motor without direct torque command or torque measurement controls;

a washer water supply system coupled to said washer basket; and a washer controller coupled to said washer drive motor and said washer water supply system so as to respectively control operation thereof, said controller comprising a load weight circuit for generating control signals to control said washer water supply system to add a load-specific volume of water to said washer basket in correspondence with a normalized inertia-based estimated load weight signal generated by said load weight circuit, said load weight circuit further being adapted for generating a normalized inertia value signal for articles loaded into said washer basket for washing on the basis of at least one acceleration measurement of said washer basket.

13. The washing machine of claim 12 further comprising a speed sensor coupled to said washer basket and to said washer controller so as to provide basket speed data to said controller.

14. The washing machine of claim 13 wherein said load weight circuit is adapted to generate said normalized inertia value signal in accordance with the following relationship:

$$I_n=(dA_o)/(dA)$$

wherein In is the normalized inertia; $dA_o$ is a predetermined value of acceleration difference for an unloaded washer basket under acceleration by two different torques of unknown value, and dA is the difference of a first and a second loaded-basket acceleration value determined when the loaded basket is under acceleration by said two different torques of unknown value.

15. The washing machine of claim 14 wherein said washer drive motor is adapted to operate at a least two respective speeds in response to control signals from said washer controller.

16. The washing machine of claim 13 wherein said load weight circuit is adapted to generate said normalized inertial value signal in accordance with the following relationship:

$$A_o/A=I_n$$

wherein $I_n$ is the normalized inertia; $A_o$ is a predetermined value of acceleration for an unloaded washer basket, and A is the first loaded-basket acceleration value.

17. The washing machine of claim 16 wherein said washer drive motor is a single speed motor.

18. The washing machine of claim 12 wherein said washing machine further comprises a clutch, said clutch being disposed to coupled said drive motor to said washer basket.

* * * * *